US006834979B1

(12) United States Patent
Cleaver et al.

(10) Patent No.: US 6,834,979 B1
(45) Date of Patent: Dec. 28, 2004

(54) ILLUMINATION DEVICE FOR SIMULATING NEON LIGHTING WITH REFLECTOR

(75) Inventors: Mark Joseph Cleaver, Wilmette, IL (US); Eric Olav Eriksson, Evanston, IL (US); George R. Hulse, Cookeville, TN (US)

(73) Assignee: iLight Technologies, Inc., Evanston, IL (US)

( * ) Notice: Subject to any disclaimer, the term of this patent is extended or adjusted under 35 U.S.C. 154(b) by 10 days.

(21) Appl. No.: 10/165,030

(22) Filed: Jun. 6, 2002

Related U.S. Application Data

(63) Continuation-in-part of application No. 09/982,705, filed on Oct. 18, 2001, now Pat. No. 6,592,238.

(51) Int. Cl.[7] ..... F21V 21/00

(52) U.S. Cl. ..... 362/219; 362/249; 362/800; 362/235

(58) Field of Search ..... 362/219, 249, 362/235, 800

(56) References Cited

U.S. PATENT DOCUMENTS

| | | | | |
|---|---|---|---|---|
| 4,607,317 A | | 8/1986 | Lin | |
| 5,057,981 A | | 10/1991 | Bowen et al. | |
| 5,879,076 A | | 3/1999 | Cross | |
| 5,964,981 A | | 10/1999 | Nelson et al. | |
| 6,146,006 A | | 11/2000 | Cross | |
| 6,158,882 A | | 12/2000 | Bischoff, Jr. | |
| 6,193,385 B1 | | 2/2001 | Maki et al. | |
| 6,217,201 B1 | | 4/2001 | Hulse | |
| 6,244,734 B1 | | 6/2001 | Hulse | |
| 6,260,991 B1 | | 7/2001 | Hulse | |
| 6,354,714 B1 | * | 3/2002 | Rhodes | 362/153.1 |
| 6,431,717 B1 | | 8/2002 | Anderson et al. | |
| 6,612,717 B2 | * | 9/2003 | Yen | 362/245 |

* cited by examiner

*Primary Examiner*—Thomas M. Sember
(74) *Attorney, Agent, or Firm*—Stites & Harbison, PLLC; Vance A. Smith; David W. Nagle, Jr.

(57) ABSTRACT

An illumination device utilizes a profiled rod or material having waveguide that preferentially scatters light entering a light receiving surface so as to along the length of the rod. A light source is positioned adjacent the light receiving surface with a reflecting member or coating juxtaposed against that surface for reflecting light into the light receiving surface.

15 Claims, 6 Drawing Sheets

ILLUMINATION DEVICE FOR SIMULATING NEON LIGHTING WITH REFLECTOR

CROSS-REFERENCE TO RELATED APPLICATIONS

This application is a continuation-in-part of the U.S. Utility patent application Ser. No. 09/982,705 filed Oct. 18, 2001 now U.S. Pat. No. 6,592,238, entitled Illuminating Device for Simulating Neon Lighting, the entire disclosure of which is incorporated herein by reference.

BACKGROUND OF THE INVENTION

The present invention relates to illumination devices using optical waveguide and, more particularly, to lighting devices for the simulation of neon lighting using optical waveguides and high intensity low voltage light sources and ideally adapted for signage and advertising uses.

Neon lighting which is produced by the electrical stimulation of the electrons in the low pressure neon gas filled glass tube has been a main stay in advertising and for outlining channel letters and building structures for many years. A characteristic of neon lighting is that the tubing encompassing the gas has an even glow over its entire length irrespective of the viewing angle. This characteristic makes neon lighting adaptable for many advertising applications including script writing and designs because the glass tubing can be fabricated into curved and twisted configurations simulating script writing and intricate designs. The even glow of neon lighting being typically devoid of hot spots allows for advertising without visual and unsightly distractions. Thus, any illumination device that is developed to duplicate the effects of neon lighting must also have even light distribution over its length and about its circumference. Equally important, such lighting devices must have a brightness that is at least comparable to neon lighting. Further, since neon lighting is a well established industry, a competitive lighting device must be light in weight and have superior "handleability" characteristics in order to make inroads into the neon lighting market. Neon lighting is recognized as being fragile in nature. Because of the fragility and heavy weight primarily due to its supporting infrastructure and power supply components, neon lighting is expensive to package and ship. Moreover, it is extremely awkward to initial handle, install, and/or replace. Any lighting device that can provide those previously enumerated positive characteristics of neon lighting while minimizing its size, weight, and handleability shortcomings will provide for a significant advance in the lighting technology.

Finally, from an environmental standpoint, neon gas has a naturally red light characteristic and thus requires the addition of various materials such as argon, mercury and phosphors to produce the varied colors required by the neon lighting industry. The fabrication of certain neon lighting clearly is burdened environmentally from having to handle some of the materials such as mercury for example.

U.S. Pat. No. 4,891,896 issued on Jan. 9, 1990 to Boren and assigned to the Gulf Development Company is an example of many attempts to duplicate neon lighting. Like this attempt, most prior art neon simulations have resulted in structures difficult to fabricate and providing a little in the way of weight and handling benefits. The Boren patent exemplifies this by providing a plastic panel with essentially bas-relief lettering. The material comprising the lettering is transparent and coated with a translucent material. The surrounding material is opaque. When the panel is back lit the lettering tends to glow with a neon-like intensity.

The more recent introduction of light weight and breakage resistant point light sources as exemplified by high intensity light emitting diodes have shown great promise to those interested in illumination devices that may simulate neon lighting and have stimulated much effort in that direction. However, the twin attributes of neon lighting, uniformity and brightness, have proven to be difficult obstacles to hurdle as such attempts to simulate neon lighting have largely been stymied by the tradeoffs between light distribution to promote the uniformity and brightness. For example, U.S. Pat. No. 4,976,057 issued Dec. 11, 1990 to Bianchi describes a device that includes a transparent or translucent hollow plastic tubing is mounted in juxtaposition to a sheet of material having light transmitting areas that are co-extensive to the tubing . The sheet is back lit by light sources such as LEDs which trace the configuration of the tubing. The tubing can be made into any shape including lettering. While the tubing may be lit by such arrangement, the light transfer efficiencies with such an arrangement is likely to result in a "glowing" tube having insufficient intensity to match that of neon lighting. The use of point light sources such as LEDs may provide intense light that rival or exceed neon lighting, but when arranged in arrays lack the uniformity needed and unfortunately provide alternate high and low intensity regions in the illuminated surfaces. Attempts to smooth out the light has resulted in lighting that has unacceptably low intensity levels.

It is therefore a paramount object of the present invention is to provide for an energy efficient, virtually unbreakable alternative to neon lighting that has the appearance of light around a substantial part of the circumference.

A further important object of the present invention is to provide for a lighting device that is safe to transport and economical to operate while providing all of the application virtues of neon lighting including uniformity and brightness.

Yet another object of the present invention is to provide for an alternative to neon lighting that is environmentally friendly, requiring no neon gas (or those additional materials for providing desired colors), and running on significantly less electricity that its neon equivalent.

Still another important object is to provide for a neon equivalent that is easy to install without complex electrical installations.

Yet a further object is to provide for a lighting device that can be placed in hostile environments such as in a freezer case without need for protective guards against accidental contact by customers.

These and other objects of the invention will become readily apparent and addressed through a reading of the discussion below and appended drawings.

SUMMARY OF THE PRESENT INVENTION

The present invention utilizes a profiled rod of material having waveguide characteristics that preferentially scatters light entering one lateral surface ("light receiving surface") so that the resulting light intensity pattern emitted by another lateral surface of the rod ("light emitting surface") is elongated along the length of the rod. A light source extends along and is positioned adjacent the light receiving surface and spaced from the light emitting surface a distance sufficient to create an elongated light intensity pattern with a major axis along the length of the rod and a minor axis that has a width that covers substantially the entire circumferential width of the light emitting surface. More specifically and in accordance with one embodiment, the profiled rod has a substantially hemispherical section contiguous with a transparent and substantially hemispherical second section that defines a groove running the length of the second section and houses the light source. A reflecting member is juxtaposed against the external curved surface of the second section. Light emitted from the light source either directly enters or is reflected into the light receiving surface of the rod and ultimately exits through the light emitting surface. The light source is a string of point light sources spaced a distance apart sufficient to permit the mapping of the light emitted by each point light source into the rod so as to create elongated and overlapping light intensity patterns along the light emitting surface and circumferentially about the surface so that the collective light intensity pattern is perceived as being uniform over the entire light emitting surface

DETAILED DESCRIPTION OF THE INVENTION

Figure 1:
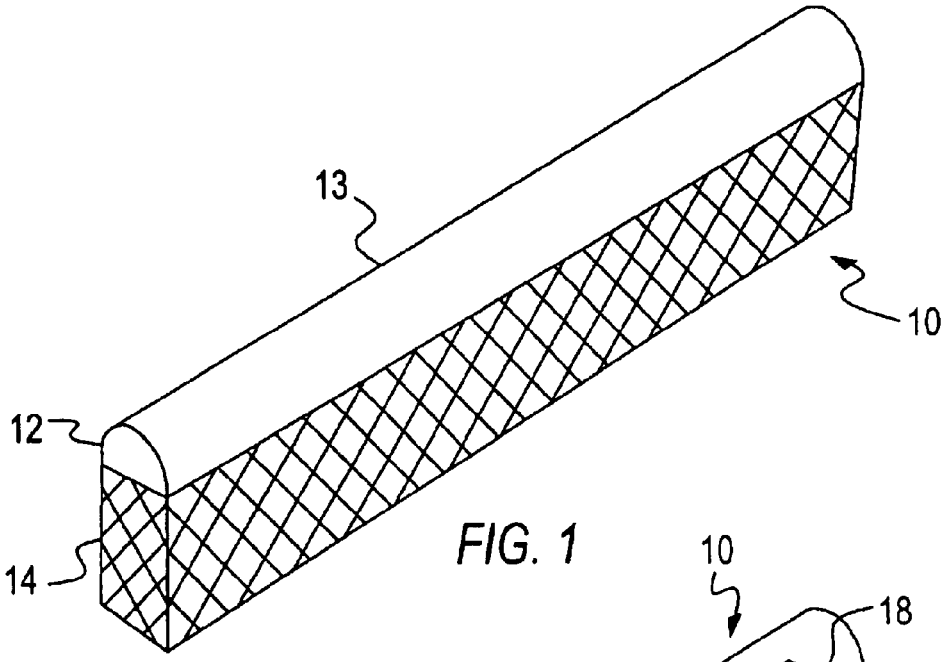
FIG. 1 is an elevated perspective view of an illumination device of the present invention.

To provide the desired result, i.e., an illumination device that is an effective simulator of neon lighting, it is important that the proper materials be selected for the component parts and those parts appropriately and geometrically positioned so that the resulting illumination device has an essentially uniform light intensity distribution pattern over the entire surface with the maximum obtainable brightness. To accomplish this, it is necessary to use a high intensity but dimensionally small light source together with an element that acts both as an optical waveguide and light scattering member, but permits light to exit laterally out of its surface (a "leaky waveguide"). By placing the light source contiguous such a leaky waveguide in a specific manner so as to cause the waveguide to uniformly glow over its lateral surface while maximizing the amount of light exiting the surface, applicants are able to obtain an illumination device that rivals or surpasses the uniform glow of neon tubing. There are many light sources which have the necessary light intensity output that is required but most are dimensionally too big to be practical, are fragile, or consume too much energy. It has been further observed that the best light source would likely be one with a small diameter that provided a uniform light output over an extended length. However, such light sources have not yet been developed to the technological state providing the intensity needed. Thus, applicants have determined that the best available light source for the purpose here intended is a string or strings of contiguously mounted, essentially point light sources such as spaced apart high intensity LEDs.

The ultimate objective of the illumination device of the present invention is to simulate an illuminated neon tube that glows with the proper intensity and uniformity over its length. Thus, applicants have determined that it is important that the leaky waveguide (used to simulate the neon tube) be comprised of a profiled rod of material having sufficient diffusivity that collectively with the other components of the invention visually eliminates any recognizable individual light distribution light pattern that originates from a respective LED or other light source. As stated above, the profiled waveguide preferentially scatters light along its length but ultimately allows light to exit through its lateral surfaces. Such a waveguide provides a visible elongated or oval-like light pattern for each LED, brightest at the center and diminishing continuously out from the center along the major and minor axis of the pattern. By spacing the LEDs a certain distance apart and each LED an appropriate distance from the exposed and lateral far side of the leaky waveguide, the light intensity distribution patterns on the surface of far side of the leaky waveguide are caused to overlap to such an extent that the variations in the patterns are evened out. This causes the collective light pattern on the lateral surface to appear to an observer to have an uniform intensity along the length of the waveguide. Other components of the illumination device of the present invention including, for example, the shape of the light sources may assist in establishing the required brightness and uniformity.

Figure 2:
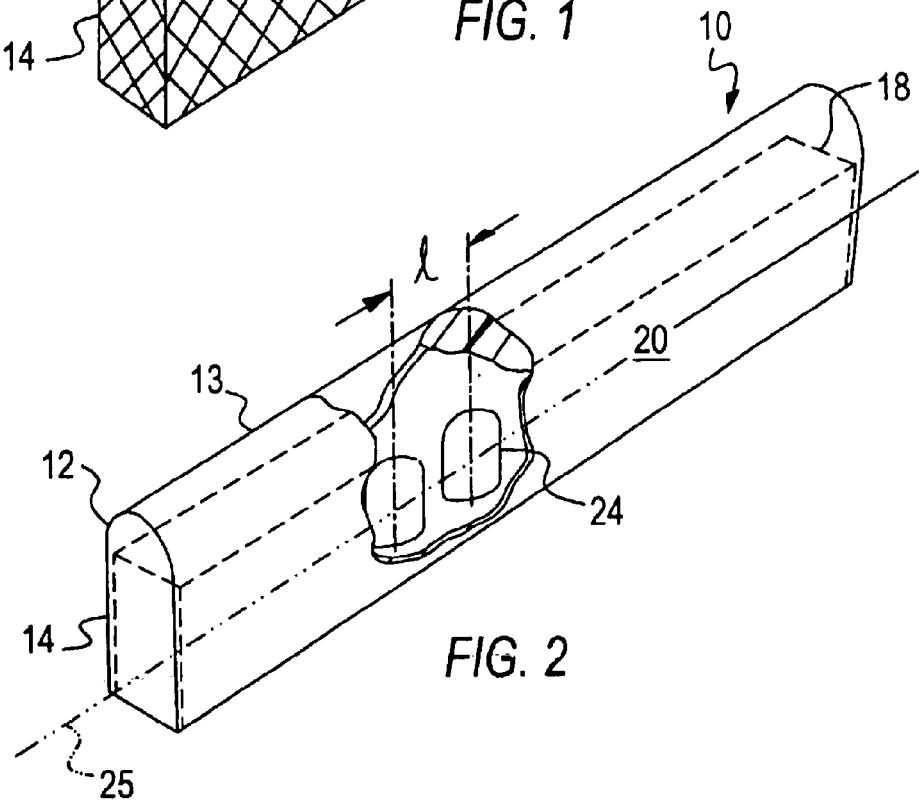
FIG. 2 is perspective similar to that of FIG. 1 with a portion broken away to show the interior.
Figure 3:
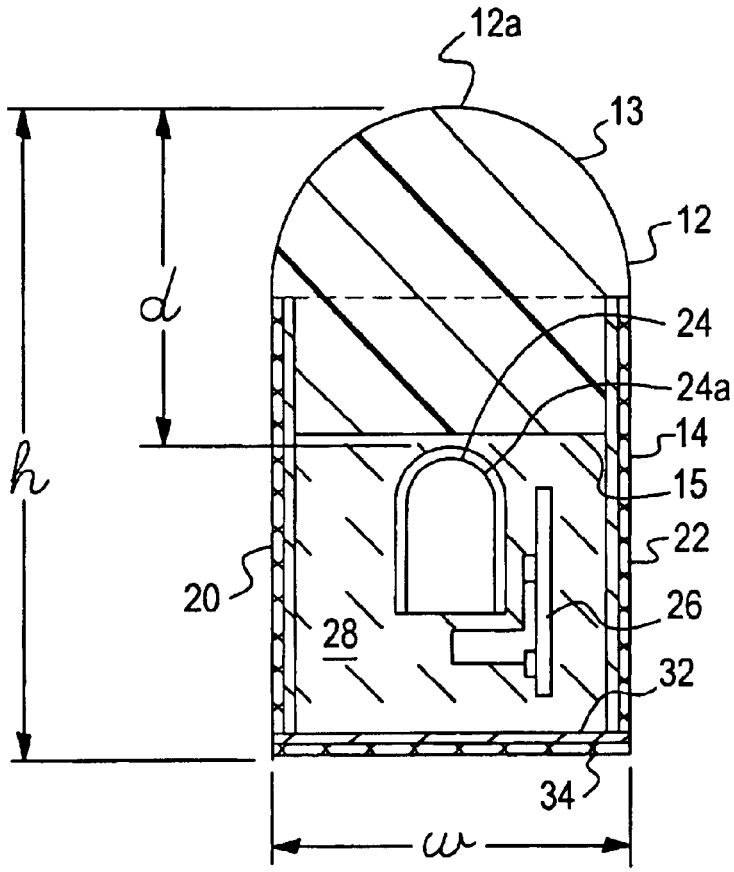
FIG. 3 is an expanded side view of the illumination device as shown in FIG. 1.

Structurally, the preferred embodiment of the present invention is portrayed in FIGS. 1–3 and shown generally as character numeral 10. The device 10 may be considered as having two major body components. The first component is a waveguide 12 having an exposed curved lateral surface 13 serving as the light emitting surface and a hidden lateral surface 15 (best seen in FIG. 3) that serves as the light receiving surface. Waveguide 12 is the aforementioned leaky waveguide and surface 13 serves as the counterpart to the neon tube. That is, the light laterally entering the waveguide from a light source juxtaposed to the surface 15 is preferentially scattered so as to exit with a broad elongated light intensity distribution pattern out of surface 13.

Visually, the waveguide 12, when not illuminated internally, has a milky appearance due to the uniform scattering of ambient light that enters the waveguide and that ultimately exits the lateral surface thereof. Applicants have found that acrylic material appropriately treated to scatter light and to have high impact resistance to be the preferred material for use in forming the waveguide components of the present invention. Moreover, such material is easily molded or extruded into rods having the desired shape for whatever illumination application may be desired, is extremely light in weight, and withstands rough shipping and handling. While acrylic material having the desired characteristics is commonly available, it can be obtained, for example, from AtoHass, Philadelphia, Pa. under order number DR66080. When shaped into a rod, such acrylic material is observed to have the leaky waveguide characteristics desired. Other materials such as such as beaded blasted acrylic or polycarbonate provided with the desired preferential light scattering characteristics may be used as well for other applications.

Figure 3A:
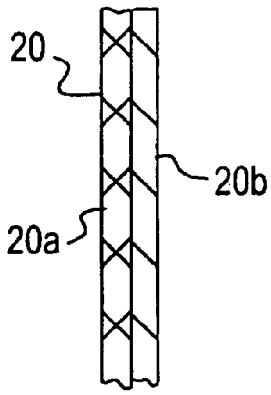
FIG. 3A is an enlarged wall segment of the illumination device shown in FIG. 3.

The second component of the present invention is a housing 14 positioned adjacent the surface 15 of the waveguide 12. Housing 14 comprises a pair of side walls 20, 22 abutting and downwardly extending from the surface 14 and defining an open ended channel 18 that extends substantially the length of waveguide 12. The housing 14 generally functions to house the light source and electrical accessories and to collect light not emitted directly into surface 15 and redirect it to the waveguide. In other words, the housing further serves to increase the light collection efficiency by reflecting the light incident upon the internal surfaces of the housing into the waveguide 12, further assisting in the scattering of the light. From a viewer's perspective, it is desirable that the visual appearance of the housing 14 not be obtrusive with respect to the glowing surface 13 of the waveguide 12; thus, it is preferred that the outside surface of the housing be light absorbing and thus visually dark to an observer. Again, it is preferred that the housing also be made from an acrylic material, reasonably resistant to impact, with the outer walls 20 and 22 having an outer regions formed from a darkly pigmented, thus light absorbing, acrylic while the inner regions are made from a white pigmented, thus light reflecting, acrylic. The two regions are best viewed in FIG. 3A show an enlarged segment of wall 20 in which the outer region 20*a* is the dark acrylic and the inner region 20*b* is the white acrylic. Such acrylic materials preferably are the same as used for the waveguide. While the waveguide 12 and housing 14 may be separately formed and then appropriately joined, it is preferred that the components be molded or extruded as a unit in long sections with the channel 18 already formed.

Figure 3B:
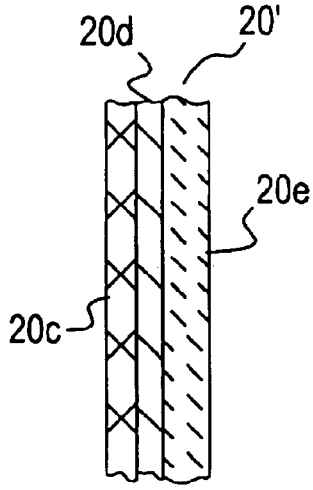
FIG. 3B is an enlarged wall segment like that shown in FIG. 3A with a variation in its structure.

An alternate wall structure is shown in FIG. 3B in which the wall 20' has three components, an outer dark region 20*c*, and intermediate light reflecting 20*d*, and a transparent wall 20*e*. The outer and intermediate regions 20*c* and 20*d* could be dark and white coatings painted on the wall 20 which itself may be comprised of a transparent acrylic material.

Although the above discussion sets forth a preferred construction of the housing, it should be understood that in some applications the reflecting and absorption characteristics may be provided by light reflecting and absorption paint or tape. Additionally, there may be little concern about the visibility of the housing. In such instances it may not be necessary to provide the light reflecting and/or absorption characteristics to the outer surface of the side walls.

Figure 4:
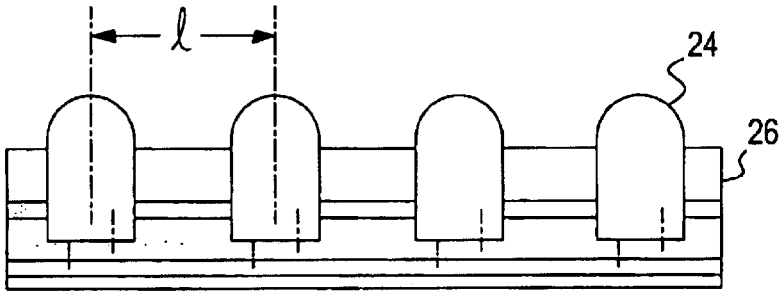
FIGS. 4, 5, and 6 are respective front, side, and top elevation views of the diodes connected to an electrical board as used in the present invention.
Figure 5:
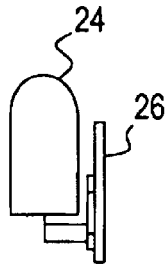

One the most beneficial attributes of the present invention is the ease that the illumination device 10 can be bent to form designs or lettering. Because the channel 18 can easily deform under bending due to the thinness of the side walls, it is preferable that when fabricating a lighting design with large bends the LEDs 24 and the electrical connection board 26 be first inserted into the channel 18 and then the channel 18 be filled with a filler compound before any bending occurs. Once the filler or potting compound has been inserted and hardened thus maintaining the positioning of the LEDs and circuit board 26, the device 10 can then be heated and bent to the desired shape or shapes. It is important, however, to observe the orientation of the circuit board 26 within channel 18 so when the device 10 is bent the board is bent about its major or planar surfaces. Thus, in the process of fabricating the illumination device 10, the LEDs 24 and electrically connected circuit board 26 are folded into the configuration as perhaps best seen in FIGS. 4, 5, and 6 and inserted into the channel 18.

Figure 5A:
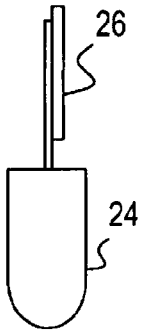
FIGS. 5A and 5B are variations in the configuration formed by the LEDs and electrical board that may be used in some applications.
Figure 5B:
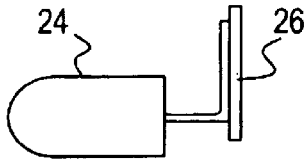

When tighter bends are desired, it is preferable that device 10 be bent to the requisite shape followed by the insertion of the LEDs, folded circuit board, and potting material. The flexibility of the circuit board 26 with attached LEDs 24 permit this post design insertion into the channel 18 with the apex of the LEDs 24 essentially abutting the lower surface of the waveguide 12 (as illustrated in FIG. 3). It is also important that the potting compound 30 used to fill channel 18 have the desired light transmitting characteristics and be effective in maintaining the positioning of both the LEDs and the board. It is preferable that the potting compound harden into an impact resistant material having an index of refraction essentially matching that of the housing 24*a* of the LEDs 24 to minimize Fresnel losses at the interface there between. The potting compound further adds strength to the structure by filling in the channel 18 and assists in reducing hot spots from forming on the lateral surface 13. Such potting compounds may be selected from commonly available clear varieties such as, for example, that obtainable from the Loctite Corporation, Rocky Hill, Conn.) under the brand name Durabond E-00CL. As is also seen in FIG. 3, the bottom surface of the device 10 may be covered with a light reflecting surface 32 which may be, for example, a white potting compound and this optional covered with a light absorbing light absorbing material 34. FIGS. 5A and 5B depict variations in the LED and circuit board that may find applicability in other and different configurations of the device where the folding of the circuit may not be necessary.

The intensity of the point light sources preferably used by the present invention are typically sufficient to provide the requisite brightness. It bears repeating that the quintessentially feature of the present invention, however, is the careful spreading or distribution of the individual light patterns of the point light sources such that the light patterns are preferentially expanded along the light emitting surface and form an oval-like light intensity pattern. Equally important is that the minor axis of the oval-like light intensity pattern extends substantially the entire circumferential width of the curved light emitting surface. The preferential spreading of each of the light intensity patterns along the waveguide also permits an the overlapping of the individual light patterns. This in turn enables the present invention to provide an observed uniform collective light pattern along and over the entire light emitting surface.

There are various parameters that have an impact on both the brightness and uniformity of the light intensity pattern emitted by the surface 13 of the waveguide 12. Among the most important are the scattering characteristics of the waveguide material, the spacing "I" between LEDs 24 as shown in FIG. 2, the lensing effect of the LED housing, the shape and structure of the housing, and the distance "d"

(shown in FIG. 3) from the apex of the LED housing 24*a* along a line perpendicular to the axis 25 of the waveguide to the apex point 12*a* on the lateral surface 13. To promote uniformity of the light intensity distribution pattern on the surface of the waveguide is that the line of LEDs 24 must be positioned a predetermined distance "d" from apex point 12*a* of the waveguide. Positioning the LEDs 24 too close to the surface will cause a "hot spot", i.e., a region of higher light intensity to locally appear on the surface 12*a* of the waveguide and spoil the quality of the uniform glow. Placing it too far from surface 12*a* will undesirably will diminish the overall light intensity emanating from the waveguide 12 and particularly about the circumferential width, i.e., along the minor axis of the oval-like light intensity pattern. As an example only, it has been determined that when the curved surface has a radius of curvature of about 3/16 inch and a circumferential width of about 9.5 mm, the device 10 (shown in FIG.3) has a height "h" of about 31.75 mm and a width "w" of about 9.5 mm. While largely depending upon the color desired, the LEDs may have a candle power of about 280 to 850 mcd and be spaced apart about 12 mm. The distance "d" is typically about 17.75 to 17.80 mm.

Figure 7A:
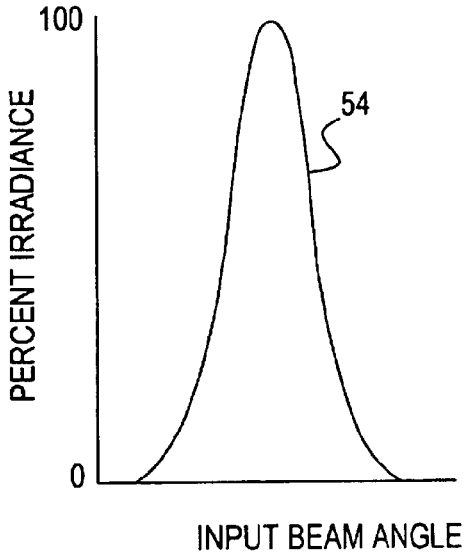
FIGS. 7A and 7B show, respectively, a graph illustrating the light distribution characteristics of a single point light source and a schematic of the device used to measure the same.
Figure 7B:
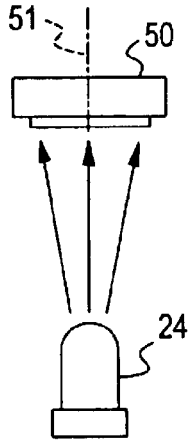
Figure 7C:
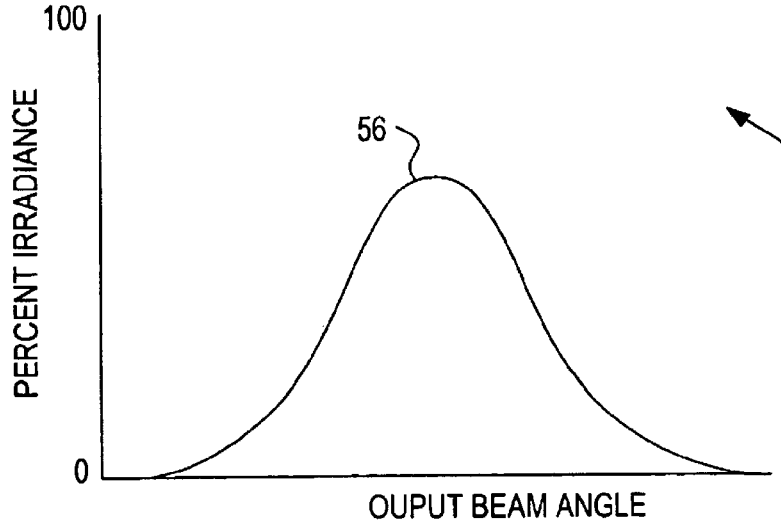
FIGS. 7C and 7D show, respectively, a graph illustrating the light distribution characteristics of a single point light source mounted within a device constructed in accordance with the present invention and a schematic of the device used to measure the same.
Figure 7D:
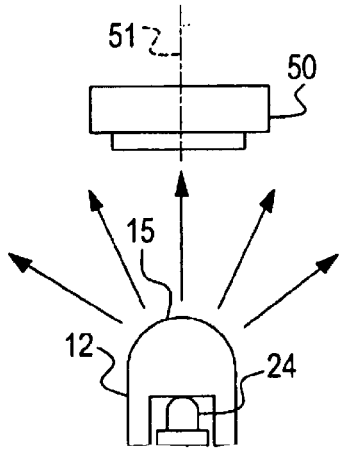
Figure 7E:
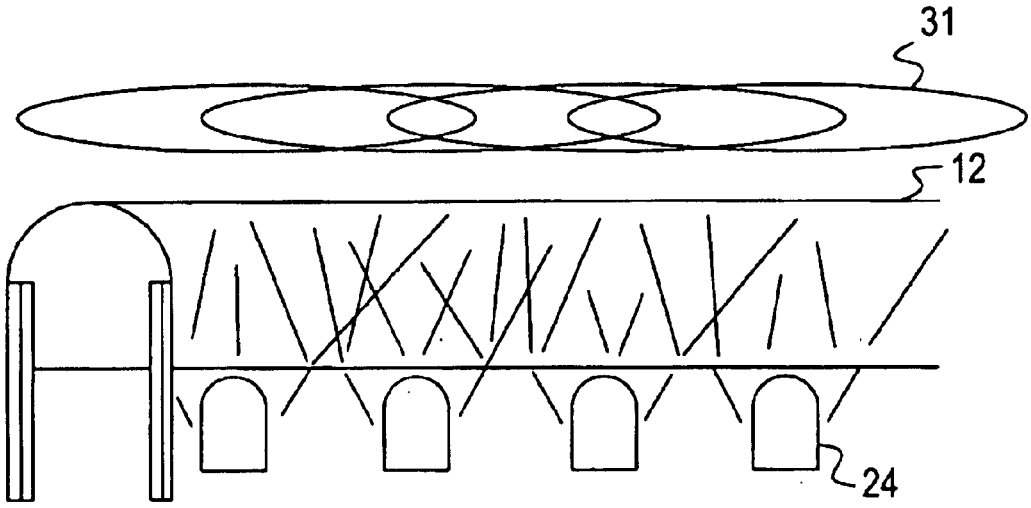
FIGS. 7E and 7F show, respectively, a Mercator-like top projection and a side schematic of the illuminated lateral surface of the waveguide with overlapping individual light distribution patterns.
Figure 7F:
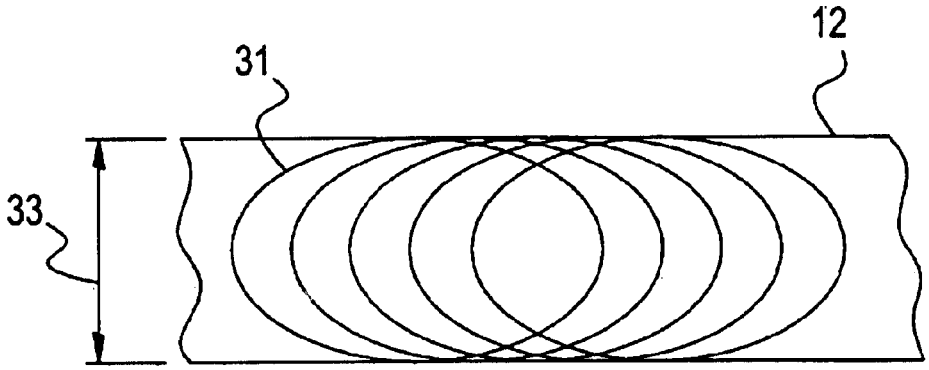

To better understand the principal under which the present invention operates, reference is now made to FIGS. 7A–7F. A single LED or point light source provides a narrow light intensity pattern 54 as graphically portrayed by FIG. 7A. Such a graph can be generated by using a photocell type of device 50 portrayed in FIG. 7B and progressively measuring the light intensity at various angles from the center line 51. This light pattern 54 should be contrasted to the one in FIG. 7C in which the pattern 56 is considerably broader with a concomitant reduction in the intensity along the center line 51. FIG. 7C represents the broad pattern emitted by the lateral surface 13 of the waveguide 12 constructed in accordance with the present invention. As stated above, it is important that the distance "d" and the LED spaced apart distance "1" be such that the oval-like intensity patterns of the individual LEDs overlap as portrayed in the schematic representation of FIG. 7E and the projection depicted in FIG. 7C schematically represents a plurality of LEDs 24 providing an broadened overlapping elliptical-like light intensity patterns 31 on the lateral surface 13 of the waveguide 12. FIG. 7F is top view using a Mercator-like projection of the light pattern areas 24 on the lateral surface. 13. The minor axis of the light intensity patterns 31 are represented by arrow 33. As stated above, for any given dimension of the waveguide and spacing of the point light sources, it is important that the distance "d" be appropriately set so that the minor axis of the light intensity distribution pattern extends substantially the entire circumferential width of the curved lateral light emitting surface 13. For purposes of this disclosure the light intensity distribution pattern can be defined as the visible area of the light pattern extending out from the center region of the area that is visible discernible by an observer.

Figure 6:
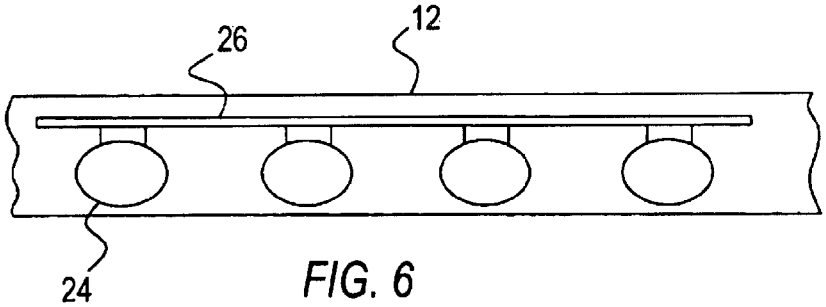
Figure 8:
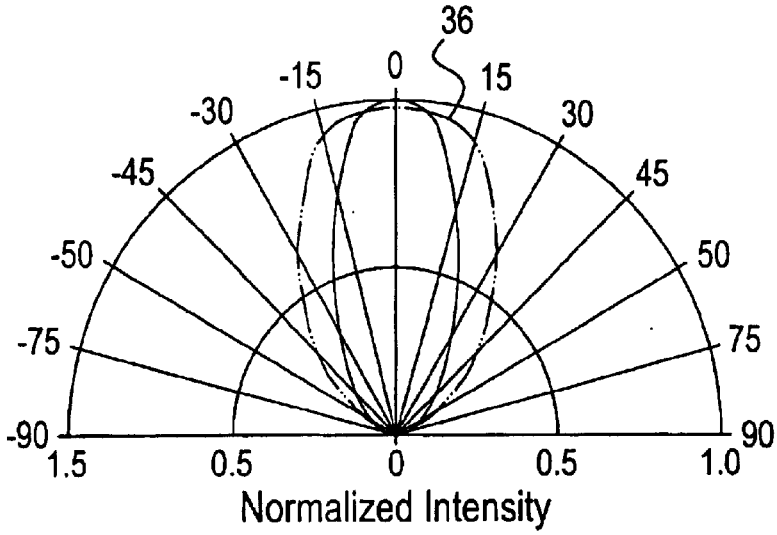
FIG. 8 is a normalized pattern of the light distribution using elliptically shaped LEDs assisting in creating the elongated light intensity pattern.

To further assist in the preferential diffusion of the light intensity pattern, applicant has determined that the use of oval shaped LEDs as shown in FIG. 6 are helpful. The best effect is obtained when the oval shaped LEDs are positioned so that the major axis of the ellipse traced by the oval seen in top elevation view is directed along the long axis of the waveguide 12. The characteristic light pattern of an oval LED is shown in FIG. 8 depicting graphically normalized light intensity along the major and minor axis. As can be seen, the oval LED tends to direct light along its major axis illustrated by the curve 36. The thin and flexible circuit board 26 can be obtained from various sources such, as, for example, VTK Industrial Limited, Kwai Chung, Hong Kong. The nature of the electrical connection and the circuitry on the board 26 depend upon the illumination sequence desired. While the circuitry is not part of the invention, it should be observed that the considerable sequence variety is permitted by the nature of the structure of the present invention. That is, the light weight, resistance to the rigors of packaging, handling, shipping, and installation, and minimal heating aspects of the illumination device permit essentially endless possibilities for lighting and color sequences.

Figure 9A:
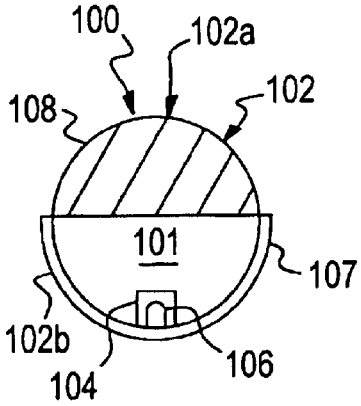
FIGS. 9A, 9B, and 9C show respective side sectional views of embodiments in which the light source is housed within a body juxtaposed to the waveguide and covered by a reflecting material.
Figure 9B:
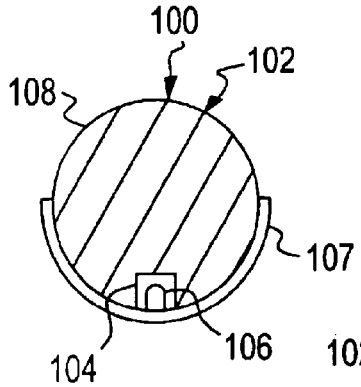
Figure 9C:
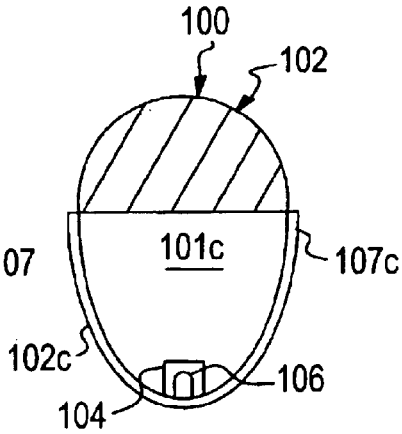
Figure 9D:
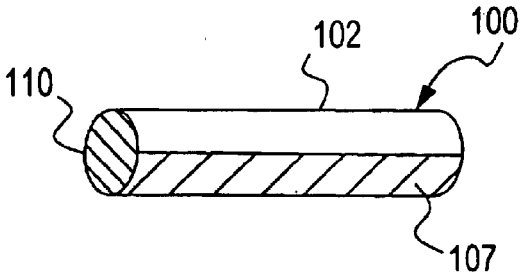
FIG. 9D is a perspective of one of the ends of the embodiments of FIGS. 9A–9C showing the ends as being covered with an internally reflecting coating or covering.

Referring now to the views depicted in FIGS. 9A–9C of additional embodiments, it may be seen that a groove 104 is defined within the body 102 of the optical device 100 that houses the LEDs 106. The spaced LEDs 106 extending the length of the groove 104 are maintained in position preferably by potting material as previously discussed. The light emitting surface 108 of the body 102 extends at least 180° about the longitudinal axis of the body. The remainder of the surface of the body, including the opening into the groove 104, is covered by a coating or covering 107 that internally reflects the light emitted by the LEDs 106 back into the body 102. Specifically, FIG. 9A illustrates the body 102 is comprised of optical waveguide material having the optical characteristics described previously herein separated from a second internally reflecting covering 107 by a space 101. Alternatively, the space could be filled with an optically transparent material. FIG. 9B depicts still another variation where the body 102 is completely comprised of the optical waveguide material and forms a rod shaped waveguide. As before, the lower part of the body 102 defines the groove 104, and the lower half is also covered by the internal reflecting material 107. Preferably, the orientation of the LEDs is as illustrated, but other orientations may be used in applications that permit such orientation. FIG. 9C illustrates the second portion 102*c* and its associated internal reflecting covering 107*c* having parabolic sections separated by space 101*e* from the optical material. This embodiment illustrates that other cylindrical and parabolic shapes may be used as applications permit and/or dictate. Again, the space may be filled with an optically transparent material as desired. FIG. 9D shows a perspective of the FIG. 9B embodiment illustrating that the ends 110 (only one end shown) of the body 102 are preferably completely covered by an internally reflecting material 107.

Figure 9E:
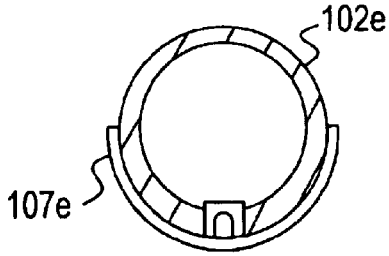
FIG. 9E is a side view of still another embodiment in which the lighting device includes a ring of material with the described optical characteristics about an interior of optically transparent material and an internally reflecting covering about the lower half of the ring.

FIG. 9E illustrates still another embodiment in which the body 102*e* is a ring of material having the previously described optical characteristics of varying radial thickness with bottom half covered by internal reflecting coating 107*e*. The radial thickness increases toward the LED, allowing the light to be incident upon its internal surface directly or by reflection and further allows light to enter into the edges proximate to the LED.

From the discussion above, it may now be appreciated that the illumination device of the present invention is rugged and resists breakage that normally would be expected for neon lighting counterparts in shipping and handling. The illumination sources, preferably solid state lighting devices such as LEDs, uses far less electrical energy and remains relative cool to the touch. This allows the illumination device of the present invention to be used in places where the heat generated by neon lighting precludes its use. Moreover, the light weight of the illumination device facilitates mounting on support structures that could not support the relative heavy weight of neon lighting and its required accessories. Finally, the illumination device is flexible in its use, allowing a tremendous variety of lighting techniques very difficult to obtain in neon lighting without substantial expense. Other advantages and uses of the present invention will be clearly obvious to those skilled in the art upon a reading of the disclosure herein and are intended to be covered by the scope of the claims set forth below.

What is claimed is:

1. An optical device for simulating neon lighting comprising:

a body having a length extending along a longitudinal axis and having an external surface, said body having a first portion including a curved light emitting surface along a portion of the external surface and extending at least 180° about the longitudinal axis of the body, and a second portion substantially contiguous to said first portion and including the remainder of the external surface, said second portion also defining an internal grove extending substantially parallel to the longitudinal axis of said body and positioned substantially diametrically opposite to said curved light emitting surface;

an elongated light source housed with and extending along said internal grove, such that said lift source is housed entirely within the portion of said body; and a reflecting coating juxtaposed against and coving substantially all of the remainder of the external surface, said reflective coating being positioned behind the light source so as to substantially prevent light from exiting from said second portion and reflecting light into said first portion, said first portion of said body having optical waveguide and light scattering characteristics such that light emitted by said elongated light source and directed into said first portion either directly from said light source or reflected by said reflecting coating is emitted in a substantially uniform intensity pattern over substantially all of said curved light emitting surface to simulate neon lighting.

2. The optical device of claim 1 in which said second portion is substantially transparent.

3. The optical device of claim 1 in which said second portion has optical waveguide and light scattering characteristics substantially similar to said first portion.

4. The optical device of claim 1 in which said first and second portions collectively form a circular rod.

5. The optical device of claim 4 in which said second portion is substantially transparent.

6. The optical device of claim 5 in which said second portion has essentially the same optical waveguide and light scattering characteristics of said first portion.

7. The optical device of claim 1 in which the external surface of said second portion is substantially parabolic in side section.

8. The optical device of claim 1 in which said elongated light source is comprised of a multiplicity of LEDs positioned in a spaced apart relationship along said groove.

9. An optical device for the simulation of neon lighting comprising:

a first elongated body portion having a predetermined length and a substantially hemispherical section defining a curved light emitting surface, said fist body portion having optical waveguide and light scattering characteristics such that light entering laterally into said elongated body is preferentially scattered along said length and emitted out through said curved light emitting surface in an elongated pattern;

a second elongated body portion juxtaposed to said first body portion with an external surface thereof covered by a light reflecting coating, said second elongated body portion further defining an internal groove extending substantially said predetermined length and positioned substantially diametrically opposite to said curved light emitting surface; and a multiplicity of electrically connected and spaced apart light emitting diodes housed within said groove such that said light source is housed entirely within the second portion of said body and such that the light emitted by each of said diodes is directed into said first body portion or reflected into said first body portion by the light reflecting coating positioned behind the light emitting diodes and substantially covering the external surface of said second body portion, said first body portion forming overlapping light intensity patterns from the respective light emitting diodes to collectively provide a uniform glow over the entire curved light emitting surface of said first body portion, thereby simulating the glow of neon lighting.

10. The optical device of claim 9 in which said second body portion and said reflecting member have hemispherical sections.

11. The optical device of claim 10 in which said second body portion is comprised of the same material as said first body portion.

12. The optical device of claim 10 in which said second body portion is essentially transparent.

13. The optical device of claim 9 in which said second body portion and reflecting member have essentially parabolic sections.

14. The optical device of claim 13 in which said second body portion is comprised of the same material as said first body portion.

15. The optical device of claim 14 in which said second body portion and reflecting member have essentially parabolic sections.

* * * * *

UNITED STATES PATENT AND TRADEMARK OFFICE

CERTIFICATE OF CORRECTION

PATENT NO. : 6,834,979 B1
DATED : December 28, 2004
INVENTOR(S) : Cleaver et al.

It is certified that error appears in the above-identified patent and that said Letters Patent is hereby corrected as shown below:

Column 9,
Line 22, change the word "with" to -- within --
Line 23, change the word "lift" to -- light --
Line 24, add the word -- second -- between "the" and "portion"
Line 25, change the word "coving" to -- covering --

Column 10,
Line 8, change the word "fist" to -- first --

Signed and Sealed this

Twenty-fourth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,834,979 B1
DATED : December 28, 2004
INVENTOR(S) : Cleaver et al.

It is certified that error appears in the above-identified patent and that said Letters Patent is hereby corrected as shown below:

Column 9,
Line 22, change the word "with" to -- within --.
Line 23, change the word "lift" to -- light --.
Line 24, add the word "second" between "the" and "portion"
Line 25, change the word "coving" to -- covering --

Column 10,
Line 8, change the word "fist" to -- first --

Signed and Sealed this

Fourteenth Day of June, 2005

JON W. DUDAS
*Director of the United States Patent and Trademark Office*